US010148029B2

(12) United States Patent
Tian et al.

(10) Patent No.: US 10,148,029 B2
(45) Date of Patent: Dec. 4, 2018

(54) SINGLE CONTRACT WITH DUAL CONTACTING FACES RESPECTIVELY EXPOSED UPON TWO OPPOSITE SURFACES OF MATING TONGUE

(71) Applicant: FOXCONN INTERCONNECT TECHNOLOGY LIMITED, Grand Cayman (KY)

(72) Inventors: Xiao-Xian Tian, Kunshan (CN); Jian-Kuang Zhu, Kunshan (CN); Wen-Fang Zhang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/688,925

(22) Filed: Aug. 29, 2017

(65) Prior Publication Data

US 2018/0062296 A1 Mar. 1, 2018

(30) Foreign Application Priority Data

Aug. 29, 2016 (CN) ..... 2016 1 0743343

(51) Int. Cl.

| | |
|---|---|
| ***H01R 13/405*** | (2006.01) |
| ***H01R 12/70*** | (2011.01) |
| ***H01R 24/60*** | (2011.01) |
| ***H01R 43/24*** | (2006.01) |
| *H01R 13/08* | (2006.01) |
| *H01R 13/50* | (2006.01) |

(Continued)

(52) U.S. Cl.

CPC ..... *H01R 13/405* (2013.01); *H01R 12/707* (2013.01); *H01R 24/60* (2013.01); *H01R 43/24* (2013.01); *H01R 13/04* (2013.01); *H01R 13/08* (2013.01); *H01R 13/50* (2013.01); *H01R 2107/00* (2013.01)

(58) Field of Classification Search

CPC ..... H01R 13/405; H01R 13/08; H01R 13/50
USPC ..... 439/736
See application file for complete search history.

(56) References Cited

U.S. PATENT DOCUMENTS 7,442,057 B2 * 10/2008 Ko ..... H01R 12/716 439/101
7,641,500 B2 * 1/2010 Stoner ..... H01R 13/633 439/357

(Continued)

FOREIGN PATENT DOCUMENTS

CN 204179288 U 2/2015
CN 105449421 A 3/2016

*Primary Examiner* — Alexander Gilman
(74) *Attorney, Agent, or Firm* — Wei Te Chung; Ming Chieh Chang

(57) ABSTRACT

An electrical connector includes an insulative housing, a plurality of terminals retained in the housing. The housing includes a base and a mating tongue extending forwardly from the base. The mating tongue forms opposite mating surfaces extending forwardly and vertically converging toward each other. The terminal includes a front contacting section, a middle retaining section rearwardly extending from the front contacting section, and a rear soldering section extending rearwardly from the middle retaining section. The front contacting section has two contacting faces respectively exposed upon the opposite mating surfaces of the mating tongue. Each terminal is made via stamping sheet metal and extends in a plane with a through hole in the front contacting section.

9 Claims, 5 Drawing Sheets

(51) Int. Cl.
*H01R 107/00* (2006.01)
*H01R 13/04* (2006.01)

(56) References Cited

U.S. PATENT DOCUMENTS

| | | | | |
|---|---|---|---|---|
| 8,920,198 | B2 * | 12/2014 | Ruschel | H01R 13/46 439/660 |
| 9,331,421 | B2 * | 5/2016 | Lai | H01R 13/5202 |
| 9,899,779 | B1 * | 2/2018 | Lin | H01R 24/60 |
| 2016/0093994 | A1 * | 3/2016 | Chen | H01R 12/724 439/607.01 |

* cited by examiner

SINGLE CONTRACT WITH DUAL CONTACTING FACES RESPECTIVELY EXPOSED UPON TWO OPPOSITE SURFACES OF MATING TONGUE

BACKGROUND OF THE DISCLOSURE

1. Field of the Disclosure

The invention is an electrical connector, and particularly to the electrical connector having the contact with dual contacting faces respectively exposed upon two opposite surfaces of the mating tongue.

2. Description of Related Arts

China CN204179288U discloses the receptacle connector having an insulative housing with a plurality of terminals therein wherein each terminal includes two beams respectively exposed upon two opposite mating surfaces of the mating tongue of the housing. Anyhow, the two opposite mating surfaces extend parallel to each other and the dual beams are required to be tightly sandwich a horizontal bar in a passageway for avoiding inadvertent split.

A dual-beam contact for use with an electrical connector with the reliable retention.

SUMMARY OF THE DISCLOSURE

To achieve the above desire, an electrical connector includes an insulative housing, a plurality of terminals retained in the housing. The housing includes a base and a mating tongue extending forwardly from the base. The mating tongue forms opposite mating surfaces extending forwardly and vertically converging toward each other. The terminal includes a front contacting section, a middle retaining section rearwardly extending from the front contacting section, and a rear soldering section extending rearwardly from the middle retaining section. The front contacting section has two contacting faces respectively exposed upon the opposite mating surfaces of the mating tongue. The rear soldering section is exposed outside of the housing for mounting to a printed circuit board. Each terminal is made via stamping sheet metal and extends in a plane with a through hole in the front contacting section, All the terminals are spaced from one another in a transverse direction and integrally formed within the housing via an insert-molding process wherein the housing includes an imaginary retention bar extending through the through holes in the transverse direction so as to prevent the terminal from moving in a vertical plane which is defined by said terminal and perpendicular to the transverse direction.

DETAILED DESCRIPTION OF THE PREFERRED EMBODIMENT

Figure 1:
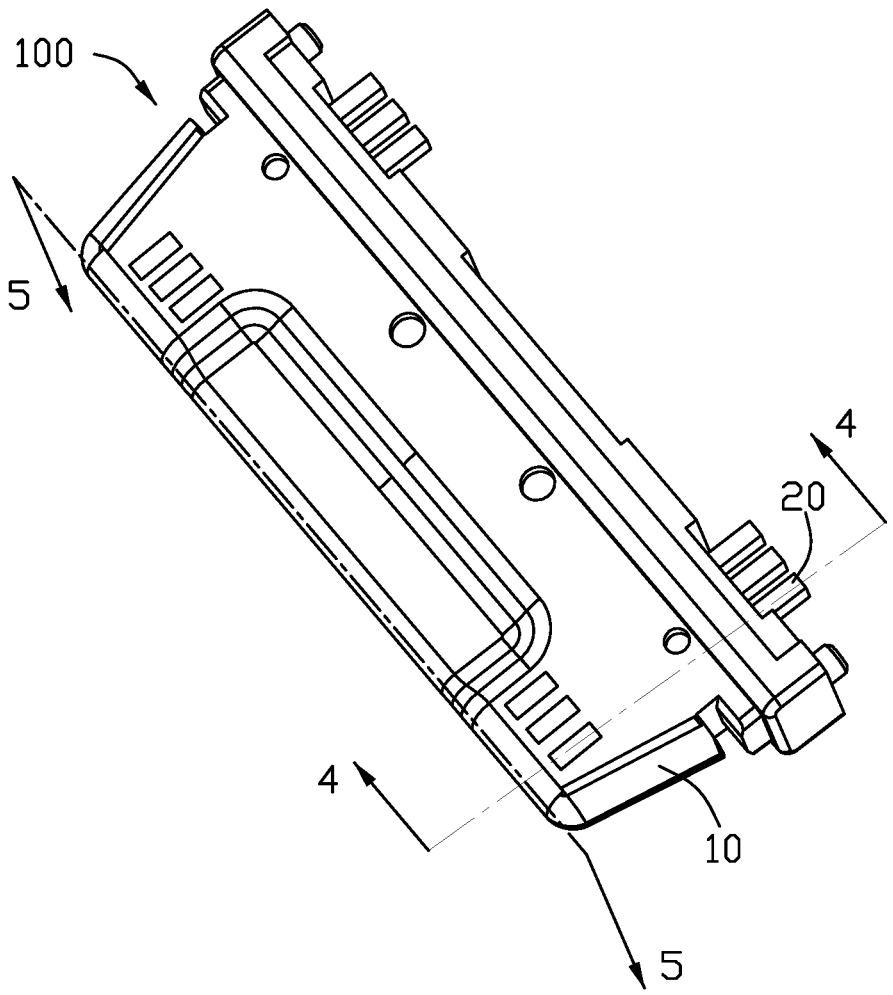
FIG. 1 is a perspective view of an electrical connector of the invention according to the presently preferred embodiment.
Figure 2:
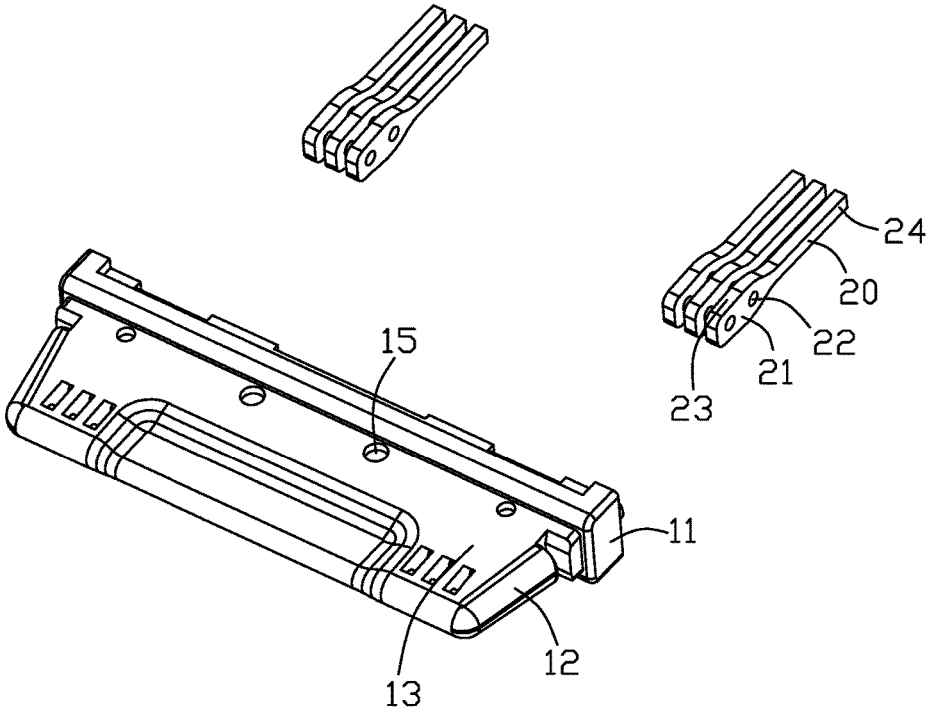
FIG. 2 is an exploded perspective view of the electrical connector of FIG. 1.
Figure 3:
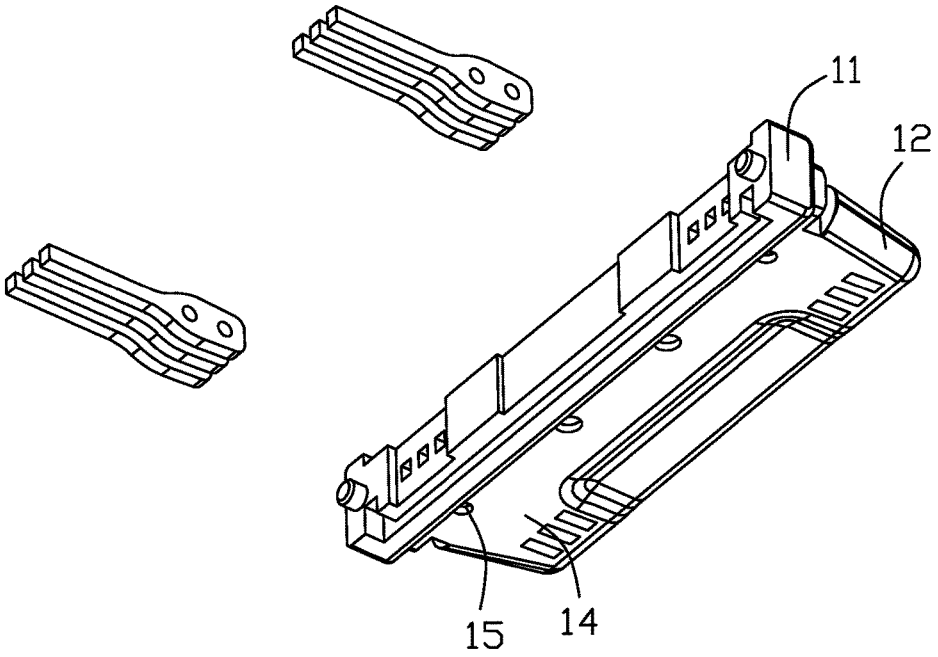
FIG. 3 is another exploded perspective view of the electrical connector of FIG. 1.
Figure 4:
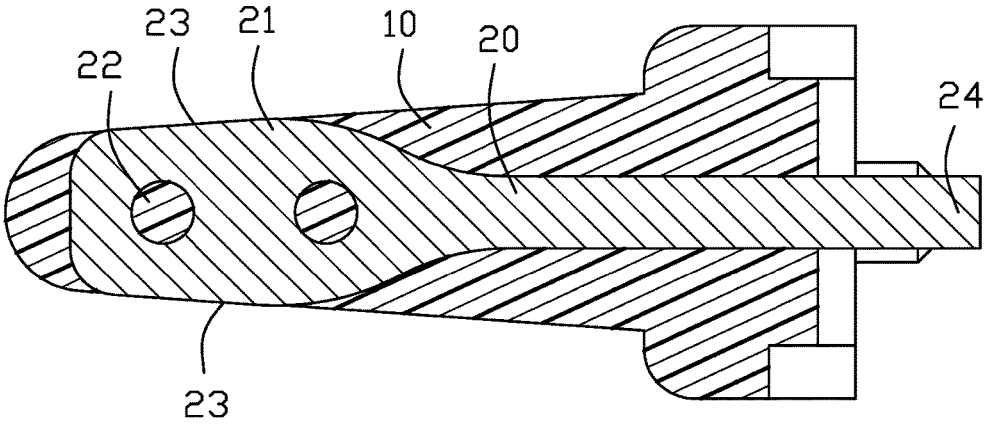
FIG. 4 is a cross-sectional view of the electrical connector of FIG. 1.
Figure 5:
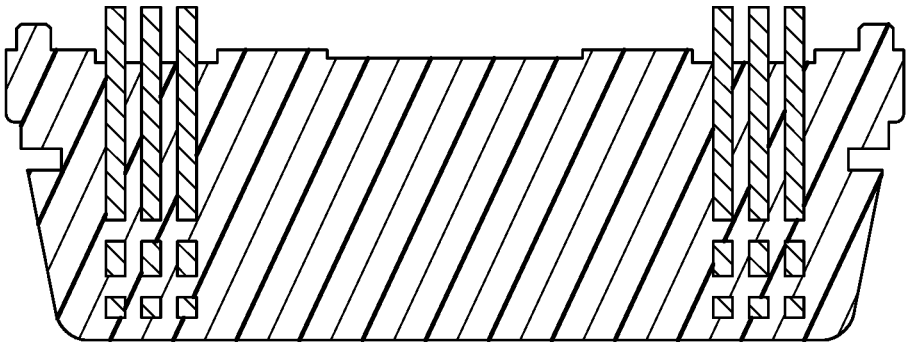
FIG. 5 is another cross-sectional view of the electrical connector of FIG. 1.

Referring to FIGS. 1-5, an electrical connector 100 for mounting to a printed circuit board (not shown), includes an insulative housing 10 and a plurality of terminals 20 retained in the housing 10. The terminals 20 includes two groups respectively disposed on two opposite sides of the housing 10 in the transverse direction. The housing 10 includes a base 11 and a mating tongue 12 extending forwardly from the base 11. The mating tongue 12 includes opposite first (oblique) mating surface 13 and second (oblique) mating surface 14 extending forwardly in a converging manner. The mating tongue 12 includes four holes 15 extending therethrough in the vertical direction.

The terminal 20 includes a front contacting section 21, a rear soldering section 24 and a middle retaining section (not labeled) therebetween in the front-to-back direction wherein the upper and lower faces of the front contacting section 21 are exposed upon the first and second mating surfaces 13 and 14 in a coplanar manner to form a pair of mating regions 23 for mating with a complementary connector, and the rear soldering section 24 is exposed outside of the base 11 for mounting to the printed circuit board. The front contacting section 21 is wider than both than the middle retaining section and the rear soldering section in the vertical direction. The front contacting section 21 includes a pair of through holes 22 filled with the insulative material of the housing 10. In other words, the housing 10 forms an imaginary transverse bar extending through the corresponding through holes 22 of terminals 20 for preventing relative movement of the terminal 20 with regard to the housing 10 in a vertical plane which is defined by each terminal 20 and perpendicular to the transverse direction.

Understandably, the terminals 20 are integrally formed with the housing 10 via an insert-molding process easily because the mating regions 23 are both exposed upon mating surfaces 13, 14 to allow the molds to directly press thereon during the insert-molding process.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing including a base, and a mating tongue forwardly extending from the base in a front-to-back direction and defining opposite first and second mating surfaces in a vertical direction perpendicular to said front-to-back direction; and a plurality of terminals disposed in the housing and spaced from one another along a transverse direction perpendicular to both said front-to-back direction and said vertical direction, each of said terminals including a front contacting section having a pair of mating regions respectively exposed upon the first and second mating surfaces, a rear soldering section exposed outside of the base, and a middle retaining section; wherein each of said terminals extends in a vertical plane defined by said front-to-back direction and said vertical direction, and integrally formed within the housing via an insert-molding process, wherein the front contacting section is wider than both the middle retaining section and the rear soldering section in the vertical direction.

2. The electrical connector as claimed in claim 1, wherein the front contacting section forms at least a through hole filled with the housing.

3. The electrical connector as claimed in claim 1, wherein the front contacting section forms a pair of through holes spaced from each other in the front-to-back direction and filled with the housing.

4. The electrical connector as claimed in claim 1, wherein the first mating surface and the second mating surface obliquely extend forwardly toward each other in a converging manner.

5. A method of making an electrical connector, comprising steps of:

having a plurality of terminals spaced from one another along a transverse direction, wherein each of said terminals is made from sheet metal and including a front contacting section, a rear soldering section and a middle retaining section therebetween in a front-to-back direction perpendicular to the transverse direction, the front contacting section forming a pair of opposite mating regions in a vertical direction perpendicular to both the transverse direction and the front-to-back direction; and integrally forming said terminals with an insulative housing via an insert-molding process; wherein the housing includes a base and a mating tongue extending forwardly from the base in said front-to-back direction and defining opposite mating surfaces in the vertical direction; wherein the pair of mating regions are exposed upon the corresponding mating surfaces, respectively; wherein the front contacting section is wider than the middle retaining section and the rear soldering section so as to prohibit backward movement of the terminal with regard to the housing, and.

6. The method as claimed in claim 5, wherein said front contacting section forms a through hole extending therethrough in the transverse direction and filled with the housing.

7. The method as claimed in claim 5, wherein said front contacting sections forms a pair of through holes spaced from each other in the front-to-back direction and extend therethrough in the transverse direction and filled with the housing.

8. The method as claimed in claim 5, wherein the first mating surface and the second mating surface obliquely extend forwardly toward each other in a converging manner.

9. An electrical connector comprising:

an insulative housing including a base, and a mating tongue forwardly extending from the base in a front-to-back direction and defining opposite first and second mating surfaces in the vertical direction perpendicular to said front-to-back direction; and a plurality of terminals disposed in the housing and spaced from one another along a transverse direction perpendicular to both said front-to-back direction and said vertical direction, each of said terminals including a front contacting section having a pair of mating regions respectively exposed upon the first and second mating surfaces, a rear soldering section exposed outside of the base, and a middle retaining section; wherein each of said terminals extends in a vertical plane defined by said front-to-back direction and said vertical direction, and integrally formed within the housing via an insert-molding process; wherein the first mating surface and the second mating surface obliquely extend forwardly toward each other in a converging manner.

* * * * *